US011104974B2

(12) United States Patent
Koo et al.

(10) Patent No.: US 11,104,974 B2
(45) Date of Patent: Aug. 31, 2021

(54) HIGH YIELD RATIO TYPE HIGH-STRENGTH COLD-ROLLED STEEL SHEET AND MANUFACTURING METHOD THEREOF

(71) Applicant: POSCO, Pohang-si (KR)

(72) Inventors: Min-Seo Koo, Gwangyang-si (KR); Seong-Ho Han, Gwangyang-si (KR)

(73) Assignee: POSCO, Pohang-si (KR)

( * ) Notice: Subject to any disclaimer, the term of this patent is extended or adjusted under 35 U.S.C. 154(b) by 275 days.

(21) Appl. No.: 16/061,867

(22) PCT Filed: Dec. 19, 2016

(86) PCT No.: PCT/KR2016/014856
§ 371 (c)(1),
(2) Date: Jun. 13, 2018

(87) PCT Pub. No.: WO2017/111407
PCT Pub. Date: Jun. 29, 2017

(65) Prior Publication Data

US 2018/0363090 A1 Dec. 20, 2018

(30) Foreign Application Priority Data

Dec. 23, 2015 (KR) ..... 10-2015-0185502

(51) Int. Cl.

| | |
|---|---|
| ***C21D 9/46*** | (2006.01) |
| ***C22C 38/02*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C21D 6/00*** | (2006.01) |
| ***C21D 8/02*** | (2006.01) |
| ***C22C 38/00*** | (2006.01) |
| ***C22C 38/38*** | (2006.01) |
| ***C22C 38/04*** | (2006.01) |

(52) U.S. Cl.

CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0247* (2013.01); *C21D 8/0263* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/005* (2013.01); *C21D 2211/008* (2013.01)

(58) Field of Classification Search

CPC ..... C21D 9/00; C21D 9/46; C21D 2211/008; C21D 8/0236; C21D 8/1233; C21D 9/48; C21D 8/0268; C21D 8/0273; C21D 8/0436; C21D 8/0468; C21D 8/1266; C21D 8/1272; C21D 1/26; C21D 1/28; C21D 1/30; C21D 1/32; C22C 38/00; C22C 38/001; C22C 38/002; C22C 38/02; C22C 38/04; C22C 38/06; C22C 38/26; C22C 38/28; C22C 38/32; C22C 38/38

See application file for complete search history.

(56) References Cited

U.S. PATENT DOCUMENTS

| | | | | |
|---|---|---|---|---|
| 2003/0084966 | A1* | 5/2003 | Ikeda | C21D 8/0273 148/320 |
| 2009/0053096 | A1* | 2/2009 | Miura | C21D 9/48 420/103 |
| 2011/0287280 | A1 | 11/2011 | Shiraki et al. | |
| 2016/0177427 | A1 | 6/2016 | Takashima et al. | |

FOREIGN PATENT DOCUMENTS

| | | |
|---|---|---|
| JP | 09025538 | 1/1997 |
| JP | 10130782 | 5/1998 |
| JP | 2010090432 | 4/2010 |
| JP | 2011246746 | 12/2011 |
| KR | 20100096840 | 9/2010 |

(Continued)

OTHER PUBLICATIONS

European Search Report—European Application No. 16879274.5, dated Aug. 28, 2018, citing JP H09 25538, KR 2012 0074798, and KR 2014 0031753.

(Continued)

*Primary Examiner* — Jophy S. Koshy
(74) *Attorney, Agent, or Firm* — Cantor Colburn LLP

(57) ABSTRACT

Provided is a cold-rolled steel sheet manufactured by a cold-rolled steel sheet manufacturing method comprising a continuous annealing step, which has a composition comprising, by weight %: C: 0.1-0.15%; Si: 0.2% or less (including 0%); Mn: 2.3-3.0%; P: 0.001-0.10%; S: 0.010% or less (including 0%); Sol.Al: 0.01-0.10%; N: 0.010% or less (excluding 0%); Cr: 0.3-0.9%; B: 0.0010-0.0030%; Ti: 0.01-0.03%; Nb:0.01-0.03%; the balance being Fe and other impurities, and satisfies following relationship 1. [relationship 1] $1650 \leq 5541.4C+239Mn+169.1Cr+0.74SS-1.36RCS \leq 1688$, in which microstructure comprises, in area %, at least 90% of martensite and tempered martensite; and 10% or less of ferrite and bainite, in which the fraction of the tempered martensite in the martensite and the tempered martensite is 90% or more, in area %, and the ratio (b/a) of the C+Mn concentration (a) in the martensite to the C+Mn concentration (b) in the ferrite and the bainite is 0.65 or more.

3 Claims, 3 Drawing Sheets

(56) References Cited

FOREIGN PATENT DOCUMENTS

| | | | |
|---|---|---|---|
| KR | 20120074798 | | 7/2012 |
| KR | 20120074798 | A * | 7/2012 |
| KR | 20130046966 | | 5/2013 |
| KR | 20130046966 | A * | 5/2013 |
| KR | 20140030970 | | 3/2014 |
| KR | 20140031752 | | 3/2014 |
| KR | 20140031753 | | 3/2014 |
| KR | 20140055463 | | 5/2014 |
| WO | 2015019557 | | 2/2015 |

OTHER PUBLICATIONS

International Search Report—PCT/KR2016/014856 dated Mar. 3, 2017.

Chinese Office Action—Chinese Application No. 20680075452.3 dated Sep. 12, 2019, citing KR20120074798, JP0925538 and WO2015019557.

* cited by examiner

HIGH YIELD RATIO TYPE HIGH-STRENGTH COLD-ROLLED STEEL SHEET AND MANUFACTURING METHOD THEREOF

TECHNICAL FIELD

The present disclosure relates to a high yield ratio (YR) type high-strength cold-rolled steel sheet, mainly used as a structural member for automobile collision resistance, and a manufacturing method thereof. More particularly, the present disclosure relates to a high yield ratio (YR) type high-strength cold-rolled steel sheet, excellent in terms of shape quality and bending properties without the occurrence of wave in width and longitudinal directions, and a manufacturing method thereof.

BACKGROUND ART

Recently, steel sheets for automobiles have been required to have a relative high strength to improve fuel economy and durability, according to various environmental regulations and energy use regulations.

Particularly, as impact stability regulations of automobiles have been spreading recently, high-strength steel excellent in terms of yield strength has been adopted as a structural member such as a member, a seat rail, a pillar, or the like, to improve impact resistance of a vehicle body.

As yield strength of the structural member is greater than tensile strength, i.e., a yield ratio (yield strength/tensile strength) is relatively high, the structural member is more advantageous in absorbing impact energy.

Generally, however, as strength of a steel sheet increases, an elongation rate is decreased, molding processability thereby being problematically lowered. Therefore, there is a need to develop a material that can solve these problems.

Generally, methods of strengthening steel include solid solution strengthening, precipitation strengthening, strengthening by grain refinement, transformation strengthening, or the like. However, these methods of solid solution strengthening and strengthening by grain refinement are disadvantageous in that it is very difficult to produce high-strength steel having tensile strength of 490 MPa or greater.

On the other hand, precipitation-strengthening type high-strength steel is made by a technique, for example, by way of adding carbide/nitride forming elements such as Cu, Nb, Ti, V and the like to precipitate carbide and nitride to strengthen a steel sheet, or suppressing grain growth by fine precipitates to refine the grain, to secure a desired strength thereof.

The technique has an advantage that a relatively high degree of strength may be easily obtained at relatively low manufacturing costs. However, it is disadvantageous that, since a recrystallization temperature is rapidly increased due to the presence of fine precipitates, high temperature annealing should be performed to ensure sufficient recrystallization to secure ductility.

In addition, precipitation-strengthened type steel strengthened by precipitating carbides/nitrides in a ferrite matrix has a problem that it is difficult to obtain high-strength steels of 600 MPa or greater.

On the other hand, ferrite-martensite dual phase steel containing hard martensite in a ferrite matrix, Transformation Induced Plasticity (TRIP) steel using transformation induced plasticity of residual austenite, Complex Phase (CP) steel composed of a hard bainite or martensite phase with a ferrite phase, or the like, has been developed, as transformation-strengthened type high-strength steel.

In addition, although hot press forming steel which secures final strength by quenching in direct contact with a die which is water-cooled after molding at a high temperature has been performed on a structural member for ensuring collision safety, an expansion of scope to be applied were not very broad, due to excessive costs incurred in facility investment, heat treatments and procedures.

In recent years, to further improve stability of a passenger in a collision, a bumper beam part considering a frontal collision characteristic in a vehicle, or a sill side part advantageous for a side collision has progressed to be super-strengthened.

These parts are mainly manufactured by using a roll forming method instead of conventional press forming methods.

A roll forming method with relatively high productivity, compared with the conventional press forming and hot press forming, is a method of manufacturing a complicated shape through multi-step roll forming, which is gradually and widely applied to the molding of parts with super-high-strength materials having a relatively low elongation.

Such parts are mainly manufactured in a continuous annealing furnace with water cooling equipment, in which a microstructure shows a tempered martensite phase, tempered with martensite. There is a disadvantage in that shape quality may be worsened due to a temperature deviation in width and longitudinal directions during water cooling, to cause workability deteriorations and material deviations by position, when roll forming is applied.

For example, Japanese Patent Application Laid-Open No. 2010-090432 relates to a method for producing a cold-rolled steel sheet, simultaneously having high strength and high ductility, and having excellent plate shape after continuous annealing, by adapting the use of tempered martensite. In this case, there is still a disadvantage that weldability may be worsened due to a relatively large amount of carbon (C) up to 0.2% or greater, and the possibility of causing a dent in a furnace due to the presence of a large amount of silicon (Si) therein may be also be of concern.

Japanese Patent Application Laid-Open No. 2011-246746 discloses a proposal for restricting an interval between inclusions of martensitic steel containing less than 1.5% of manganese (Mn) to improve bending properties. However, even in this case, there is a problem that, since hardenability may be deteriorated due to the presence of a relatively small amount of alloying components, a very high cooling rate is required at the time of cooling, and, thereby, shape quality may largely be worsened.

Korean Patent Laid-Open Nos. 2014-0031752 and 2014-0031753 provide techniques and securing strength and shape quality by controlling a phase transformation for hot-dip coating and improving the shape quality of conventional water-cooled martensitic steel. Further, Korean Patent Publication No. 2014-0030970 provides a method of increasing yield strength of martensitic steel.

The above techniques relate to high-alloying type martensite steel, and are superior in shape quality to a water-cooled low-alloying type martensitic steel. However, since they have disadvantages to being worsened in roll-forming properties and bending properties, in which the latter is an important characteristic for improving collision property at the time of collision, it is still necessary to overcome these disadvantages.

DISCLOSURE

Technical Problem

An aspect of the present disclosure may provide a high yield ratio (YR) type high-strength cold-rolled steel sheet, excellent in terms of shape quality and bending properties, without the occurrence of wave in width and longitudinal directions.

Another aspect of the present disclosure may provide a method of manufacturing a high yield ratio (YR) type high-strength cold-rolled steel sheet, excellent in terms of shape quality and bending properties without the occurrence of wave in width and longitudinal directions, by way of controlling a composition of steel, and a manufacturing condition.

Technical Solution

An aspect of the present disclosure is a high yield ratio type high-strength cold-rolled steel sheet produced by a manufacturing method of a cold-rolled steel sheet, comprising continuous annealing, which has a composition comprising, by weight, 0.1% to 0.15% of carbon (C), 0.2% or less (including 0%) of silicon (Si), 2.3% to 3.0% of manganese (Mn), 0.001% to 0.10% of phosphorus (P), 0.010% or less (including 0%) of sulfur (S), 0.01% to 0.10% of Sol. aluminum (Al), 0.010% or less (excluding 0%) of nitrogen (N), 0.3% to 0.9% of chromium (Cr), 0.0010% to 0.0030% of boron (B), 0.01% to 0.03% of titanium (Ti), 0.01% to 0.03% of niobium (Nb), a remainder of iron (Fe) and other impurities, wherein the steel sheet satisfies the following relationship 1, $$1650 \leq 5541.4C+239Mn+169.1Cr+0.74SS-1.36RCS \leq 1688 \quad \text{[relationship 1]}$$

(wherein C, Mn and Cr are values indicating amounts of each element in weight %, SS is a continuous annealing temperature (° C.), and RCS is a cooling ending temperature (° C.) at the time of continuous annealing).

wherein a microstructure comprises, by area %, 90% or greater of martensite and tempered martensite, and 10% or less of ferrite and bainite, wherein a fraction of the tempered martensite in the total of martensite and tempered martensite is, by area %, 90% or greater, and wherein a ratio (b/a) of C+Mn concentration in the martensite (a) to C+Mn concentration in the total of ferrite and bainite (b) is 0.65 or greater.

An aspect of the present disclosure is a manufacturing method of a high yield ratio type high-strength cold-rolled steel sheet comprising:

reheating a steel slab comprising, by weight, 0.1% to 0.15% of carbon (C), 0.2% or less (including 0%) of silicon (Si), 2.3% to 3.0% of manganese (Mn), 0.001% to 0.10% of phosphorus (P), 0.010% or less (including 0%) of sulfur (S), 0.01% to 0.10% of Sol. aluminum (Al), 0.010% or less (excluding 0%) of nitrogen (N), 0.3% to 0.9% of chromium (Cr), 0.0010% to 0.0030% of boron (B), 0.01% to 0.03% of titanium (Ti), 0.01% to 0.03% of niobium (Nb), a remainder of iron (Fe) and other impurities, and hot-rolling the steel slab at a hot finish rolling temperature of 800° C. to 950° C. to obtain a hot-rolled steel sheet;

coiling the hot-rolled steel sheet at a temperature within a range of 500° C. to 750° C.;

cold-rolling the hot-rolled steel sheet at a reduction ratio of 40% to 70% to obtain a cold-rolled steel sheet;

maintaining the cold-rolled steel sheet at a continuous annealing temperature of 770° C. to 830° C., primarily cooling the cold-rolled steel sheet to a temperature within a range of 650° C. to 700° C. at a cooling rate of 1° C. to 10° C./sec, secondarily cooling the cold-rolled steel sheet to a cooling ending temperature of 250° C. to 330° C. at a cooling rate of 5° C. to 20° C./sec, and performing continuous annealing to be over-aged; and subjecting the continuous annealed steel sheet to skin pass rolling at a reduction ratio of 0.1% to 1.0%;

wherein the continuous annealing temperature (° C.) and the cooling ending temperature (° C.) satisfy the following relationship 1:

$$1650 \leq 5541.4C+239Mn+169.1Cr+0.74SS-1.36RCS \leq 1688 \quad \text{[relationship 1]}$$

(wherein C, Mn and Cr are values indicating amounts of each element in weight %, SS is a continuous annealing temperature (° C.), and RCS is a cooling ending temperature (° C.) at the time of continuous annealing).

Advantageous Effects

According to a preferred aspect of the present disclosure, it is possible to provide a high yield ratio (YR) type high-strength cold-rolled steel sheet, excellent in terms of shape quality and bending properties without the occurrence of wave in width and longitudinal directions.

BEST MODE FOR INVENTION

Figure 1:
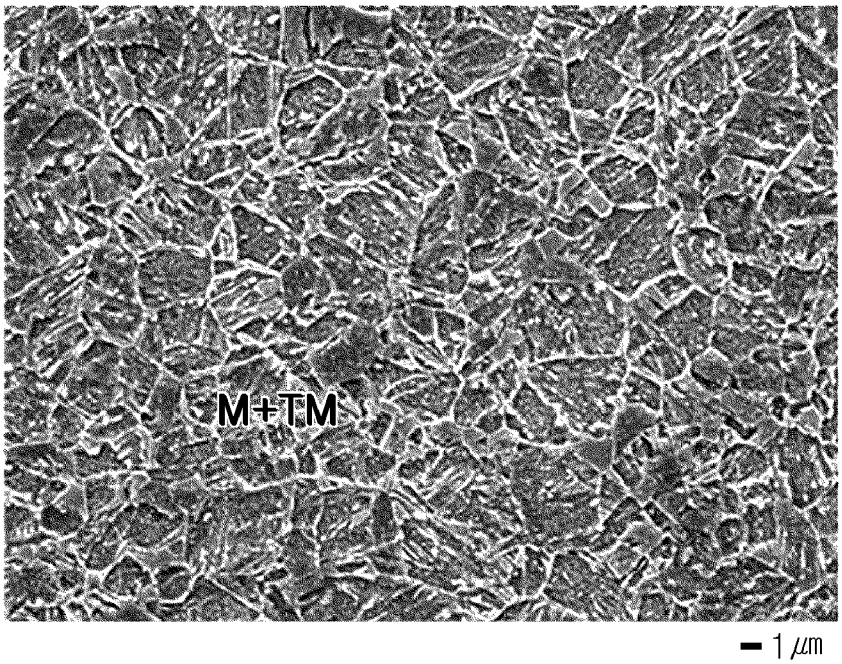
FIG. 1 is a microstructure photograph of inventive steel 3 produced under conditions of an annealing temperature of 820° C. and a cooling ending temperature (RCS) of 330° C.

Hereinafter, the present disclosure will be described.

Hereinafter, reasons for limiting components and component ranges of steel will be described.

C: 0.1% to 0.15%

Carbon (C) in steel may be a very important element added to strengthen a transformed structure. Carbon may promote high strengthening, and promote a formation of martensite from steel having a transformed structure. As an amount of carbon increases, an amount of martensite in steel may increase. When an amount of carbon exceeds 0.15%, weld defects may occur, to worsen weldability in a case of machining parts by a customer. When an amount of carbon is as low as less than 0.1%, it may be difficult to secure sufficient strength.

Therefore, an amount of C is preferably limited to 0.1% to 0.15% of C.

Si: 0.2% or less (including 0%)

Silicon (Si) in steel may accelerate ferrite transformation, and increase an amount of carbon in untransformed austenite to form a composite structure of ferrite and martensite, thereby hindering an increase in strength of martensite. It may be also desirable to limit the possible additions, as it not only causes surface scale defects in terms of surface properties, but also degrades chemical conversion treatment properties. Therefore, an amount of Si is preferably limited to 0.2% or less (including 0%).

Mn: 2.3% to 3.0%

Manganese (Mn) in steel may be an element for refining grains without damaging ductility, precipitating sulfur in steel completely into MnS to prevent hot brittleness due to a formation of FeS, and strengthening the steel. In addition, Mn may play a role in reducing a critical cooling rate in which a martensite phase is obtained. Therefore, martensite may be more easily formed.

When an amount of manganese is less than 2.3%, it may be difficult to secure a desired degree of strength. When an amount of manganese exceeds 3.0%, there may be high in a possibility that problems such as weldability and hot-rolling property are likely to occur. Therefore, an amount of Mn is preferably limited to 2.3% to 3.0%.

P: 0.001% to 0.10%

Phosphorus (P) in steel may be a substitutional alloying element having the largest effect of solid solution strengthening, and serve to improve in-plane anisotropy and enhance strength. When an amount of phosphorus is less than 0.001%, an effect therefrom may not be sufficiently secured, and a problem of production costs may be caused. On the other hand, when phosphorus is added in an excessive amount, press formability may be deteriorated, and brittleness of steel may be generated.

Therefore, an amount of P is preferably limited to 0.001% to 0.10%.

S: 0.010% or less (including 0%)

Sulfur (S) in steel may be an impurity element in steel, and may be an element that hinders ductility and weldability of a steel sheet. When an amount of sulfur exceeds 0.01%, the ductility and weldability of the steel sheet are likely to be deteriorated.

Therefore, it may be preferable that an amount of S is limited to 0.01% or less (including 0%).

Sol.Al: 0.01% to 0.10%

Soluble aluminum (Sol.Al) in steel may be a component effective to combine with oxygen in steel to deoxidize, and distribute carbon in ferrite into austenite to improve martensite hardenability. When an amount of soluble aluminum is less than 0.01%, the above effect may not be sufficiently secured. When an amount of soluble aluminum exceeds 0.1%, the above effect may be saturated and production costs may increase. Therefore, an amount of soluble Al is preferably limited to 0.01% to 0.10%.

N: 0.010% or less (excluding 0%)

Nitrogen (N) in steel may be a component effective to stabilize austenite. When an amount of nitrogen exceeds 0.01%, a risk of cracking during a continuous casting process due to formation of AlN or the like may be increased.

Therefore, an upper limit of an amount of N is preferably limited to 0.010% (excluding 0%).

Cr: 0.3% to 0.9% chromium (Cr) may be a component added to improve the hardenability of steel and ensure high-strength, and may play an important role in forming martensite, which may be a low temperature transformation phase. When an amount of Cr is less than 0.3%, it may be difficult to secure the above effect. When an amount of Cr exceeds 0.9%, the effect may be saturated and economically disadvantageous. Therefore, an amount of Cr is preferably limited to 0.3% to 0.9%.

B: 0.0010% to 0.0030%

Boron (B) in steel may be a component that delays the transformation of austenite into pearlite in the process of cooling during annealing, and may be an element that inhibits the formation of ferrite and promotes the formation of martensite. When an amount of B is less than 0.0010%, it may be difficult to sufficiently obtain the above effect. When an amount of B is greater than 0.0030%, costs originating therefrom may increase due to the presence of an excess of alloying iron.

An amount of B is preferably limited to 0.0010% to 0.0030%.

Ti: 0.01% to 0.03%, Nb: 0.01% to 0.03%

Titanium (Ti) and niobium (Nb) in steel are effective elements for increasing strength and refining a grain diameter of a steel sheet. When the respective amounts of Ti and Nb are less than 0.01%, it may be difficult to sufficiently secure such effects. When the respective amounts of Ti and Nb exceed 0.03%, the ductility may be greatly lowered due to an increase in manufacturing costs and excessive precipitates. Therefore, the contents of Ti and Nb are preferably limited to 0.01% to 0.03%, respectively.

In addition to the above-mentioned components, other Fe and other unavoidable impurities.

In a preferred aspect of the present disclosure, the following relationship 1 should be satisfied:

$$1650 \leq 5541.4C+239Mn+169.1Cr+0.74SS-1.36RCS \leq 1688 \quad \text{[relationship 1]}$$

(wherein C, Mn and Cr are values indicating an amount of each element in weight %, SS is a continuous annealing temperature (° C.), and RCS is a cooling ending temperature (° C.) at the time of continuous annealing.)

More preferably, the continuous annealing temperature may be controlled to be within the range of 770° C. to 830° C., and the cooling ending temperature may be controlled to be within the range of 250° C. to 330° C., under conditions that an amount of carbon and Cr satisfies the above described component ranges of the present disclosure. The continuous annealing temperature (SS) and the cooling ending temperature (RCS) may be controlled using a correlation between the continuous annealing temperature and the cooling ending temperature such as relationship 1.

When these conditions are not satisfied, the yield strength may be low and the desired yield ratio of 0.77 or greater may not be obtained.

A preferred example of the cold-rolled steel sheet of the present disclosure may be a cold-rolled steel sheet having, by area %, 90% or greater of martensite and tempered martensite; and 10% or less of ferrite and bainite.

A fraction of the tempered martensite in the total of martensite and tempered martensite may be, by area %, preferably 90% or greater.

It may be very important to secure a proper martensite fraction to secure a high yield ratio.

A ratio (b/a) of C+Mn concentration in the martensite (a) to C+Mn concentration (b) in the total of ferrite and bainite may be preferably 0.65 or greater.

An example of a preferred high yield ratio type high-strength cold-rolled steel sheet of the present disclosure may have yield strength of 920 MPa or greater, tensile strength of 1200 MPa or greater, a yield ratio of 0.77 or greater, elongation of 6% or greater, and a bending index of 3% or lower (R/t: R: Radius of Curvature, t: Thickness of Specimen).

Another example of a preferred high yield ratio type high-strength cold-rolled steel sheet of the present disclosure may have tensile strength of 1200 MPa to 1300 MPa.

Hereinafter, a method of manufacturing a high yield ratio type high-strength cold-rolled steel sheet according to another preferred embodiment of the present disclosure will be described.

After reheating the steel slab formed as described above, the reheated slab may be hot-rolled to obtain a hot-rolled steel sheet.

During the hot-rolling, the hot finish rolling temperature may be preferably set to a temperature from 800° C. to 950° C.

When the hot finish rolling temperature is lower than 800° C., there may be a high possibility that hot deformation resistance will sharply increase. Further, a top portion, a tail portion and an edge portion of a hot-rolled coil may become single-phase regions, and an increase of the in-plane anisotropy and formability may be deteriorated. On the other hand, when the temperature exceeds 950° C., not only a thick oxidizing scale may be generated, but also the microstructure of the steel sheet may be likely to be coarsened.

Therefore, the hot finish rolling temperature is preferably limited to 800° C. to 950° C.

The hot-rolled steel sheet may be coiled at a temperature within a range of 500° C. to 750° C.

When the coiling temperature is less than 500° C., excessive amounts of martensite or bainite may be generated to cause an excessive increase in strength of the hot-rolled steel sheet, which may cause manufacturing problems such as shape defects due to a load during cold-rolling. On the other hand, when the temperature exceeds 750° C., pickling property may be deteriorated due to an increase in a surface scale. Therefore, the coiling temperature is preferably limited to a temperature within a range of 500° C. to 750° C.

It may be preferable to pickle and cold-roll the hot-rolled steel sheet to obtain a cold-rolled steel sheet.

A reduction ratio in the cold-rolling may be preferably 40% to 70%.

When the reduction rate is less than 40%, the recrystallization driving force may be weakened, which may cause problems in obtaining a good recrystallized grain, and a shape correction may be difficult.

When the reduction rate exceeds 70%, there may be a high possibility that cracks will occur at an edge portion of the steel sheet, and a rolling load will increase rapidly.

The cold-rolled steel sheet may be maintained at an annealing temperature range of 770° C. to 830° C., primarily cooled to a temperature within a range of 650° C. to 700° C. at a cooling rate of 1 to 10° C./sec, and cooled to a cooling ending temperature of 250° C. to 330° C. at a cooling rate of 5 to 20° C./sec, and then performed continuous annealing to be over-aged.

At this time, the continuous annealing temperature and the cooling ending temperature should satisfy the following relationship 1:

$$1650 \leq 5541.4C+239Mn+169.1Cr+0.74SS-1.36RCS \leq 1688 \quad \text{[relationship 1]}$$

(wherein C, Mn and Cr are values indicating an amount of each element in weight %, SS is a continuous annealing temperature (° C.), and RCS is a cooling ending temperature (° C.) at the time of continuous annealing.)

Even when the annealing temperature satisfies the above-mentioned relationship 1, but the annealing temperature is lower than 770° C., a large amount of ferrite may be produced to lower yield strength. Therefore, it may be difficult to produce a steel material having a high yield ratio of 0.77 or greater.

When the annealing temperature exceeds 830° C., an increase in size of austenitic grains due to a high temperature annealing increases a size of martensitic packet produced at the time of cooling, making it difficult to secure a desired tensile strength.

Therefore, the continuous annealing temperature may be specified to satisfy the relationship 1 in the temperature range of 770° C. to 830° C.

The steel sheet maintained at the above-mentioned continuous annealing temperature may be primarily cooled to 650° C. to 700° C. at a cooling rate of 1 to 10° C./sec.

The primary cooling step may be to inhibit ferrite transformation such that most of austenite may be transformed into martensite.

After the primary cooling, secondary cooling may be performed at a cooling rate of 5 to 20° C./sec to a cooling ending temperature of 250 to 330° C., followed by performing a over-aging treatment.

The secondary cooling ending temperature may be a temperature condition that is very important for ensuring a high yield ratio as well as shape quality in width and longitudinal directions in a coil. When the cooling ending temperature is be less than 250° C., an excessive increase in the amount of martensite during the over-aging treatment, the yield strength and the tensile strength may increase simultaneously, and the ductility may deteriorate. Particularly, shape deterioration due to quenching may occur, and thus, worsening of workability during roll forming may be expected.

On the other hand, when the temperature is higher than 330° C., austenite produced during annealing may not be transformed into martensite. In this case, bainite, granular bainite, and the like, high-temperature transformation phases, may be generated in large amounts, and the yield strength may be rapidly deteriorated. The occurrence of such a structure may be accompanied by a decrease in the yield ratio, making it impossible to produce a desired high yield ratio type ultra high-strength steel.

The heat treated steel sheet as described above may be subjected to skin pass rolling at a reduction ratio of 0.1% to 1.0%.

Generally, when transformed structure steel is subjected to skin pass rolling, an increase in yield strength of at least 50 Mpa or greater may occur with little increase in tensile strength. When the reduction rate is less than 0.1%, it may be very difficult to control a shape of ultra high-strength steel, as in the present disclosure. When the reduction ratio exceeds 1.0%, workability may be greatly unstable due to the high stretching operation. Therefore, the reduction rate at the time of skin pass rolling is limited to 0.1% to 1.0%.

According to a preferred embodiment of the manufacturing method of the present disclosure, a high yield ratio type high-strength cold-rolled steel sheet having yield strength of 920 MPa or greater, a tensile strength of 1200 MPa or greater, a yield ratio of 0.77 or greater, an elongation of 6% or greater, and a bending index of 3% or lower (R/t: R: Radius of Curvature, t: Thickness of Specimen) may be produced.

According to another preferred example of the manufacturing method of the present disclosure, a high yield ratio type high-strength cold-rolled steel sheet having tensile strength of 1200 MPa to 1300 MPa may be produced.

MODE FOR INVENTION

Hereinafter, the present disclosure will be described in more detail byway of example. However, the following examples are only illustrative of the present disclosure in more detail, and do not limit the scope of the present disclosure.

Example 1

A steel slab formed as shown in Table 1 below was melted under vacuum, heated at a reheating temperature of 1200° C. for 1 hour in a heating furnace, and hot-rolled to obtain a hot-rolled steel sheet, followed by coiling. At this time, the hot-rolling was finished at a temperature of 880° C., and the coiling temperature was set at a temperature of 680° C. The hot-rolled steel sheet was pickled and cold-rolled at a cold reduction rate of 50% to obtain a cold-rolled steel sheet. The cold-rolled steel sheet was subjected to continuous annealing under conditions shown in Table 1, and skin pass rolling was finally performed at a rolling rate of 0.2%. At the time of the continuous annealing, a primary cooling rate was 2° C./sec, a primary cooling ending temperature was 650° C., and a secondary cooling rate was 15° C./sec.

A tensile test specimen of JIS No. 5 was prepared from the cold-rolled steel sheet produced as described above, and properties of the material (yield strength, tensile strength, yield ratio, elongation) and a microstructure of the material were observed, and results obtained therefrom are shown in Table 2.

On the other hand, a microstructure of a steel material (Inventive Steel 3) produced under conditions of an annealing temperature of 820° C. and a cooling ending temperature (RCS) of 330° C. was observed, and results obtained therefrom are shown in FIG. 1. Meanwhile, on the basis of Inventive Steel 3, a microstructure of a steel material (Comparative Steel 2) produced under conditions of an annealing temperature of 820° C. and a cooling ending temperature (RCS) of 410° C. was observed, and results obtained therefrom were shown in FIG. 2.

TABLE 1

| C | Mn | Si | P | S | Al | Cr | Ti | Nb | B | N | SS (° C.) | RCS (° C.) | Steel | Relationship 1 |
|---|---|---|---|---|---|---|---|---|---|---|---|---|---|---|
| 0.1 | 2.8 | 0.1 | 0.01 | 0.002 | 0.03 | 0.9 | 0.03 | 0.03 | 0.0023 | 0.005 | 830 | 250 | Inventive Steel 1 | 1650 |
| 0.13 | 2.5 | 0.12 | 0.01 | 0.004 | 0.03 | 0.7 | 0.02 | 0.03 | 0.0019 | 0.004 | 820 | 270 | Inventive Steel 2 | 1676 |
| | | | | | | | | | | | 850 | 270 | Comparative Steel 1 | 1698 |
| 0.15 | 2.5 | 0.1 | 0.01 | 0.003 | 0.07 | 0.6 | 0.02 | 0.03 | 0.0022 | 0.005 | 820 | 330 | Inventive Steel 3 | 1688 |
| | | | | | | | | | | | 820 | 410 | Comparative Steel 2 | 1579 |
| 0.16 | 2.2 | 0.1 | 0.011 | 0.005 | 0.044 | 0.9 | 0.04 | 0.02 | 0.002 | 0.005 | 810 | 310 | Comparative Steel 3 | 1742 |
| 0.14 | 3.3 | 0.1 | 0.01 | 0.003 | 0.035 | 0.6 | 0.04 | 0.02 | 0.002 | 0.006 | 810 | 310 | Comparative Steel 4 | 1844 |
| 0.2 | 2.7 | 0.1 | 0.01 | 0.004 | 0.033 | 0.7 | 0.04 | 0.02 | 0.002 | 0.007 | 810 | 310 | Comparative Steel 5 | 2050 |

TABLE 2

| | Microstructure Fraction (%) | | | | | | | |
|---|---|---|---|---|---|---|---|---|
| Steel No. | FM + TM (TM Fraction) | F + B | b/a | YS (MPa) | TS (MPa) | El (%) | YR | R/t |
| Inventive Steel 1 | 91(82) | 9 | 0.67 | 969 | 1205 | 8.9 | 0.80 | 2.9 |
| Inventive Steel 2 | 90(81) | 10 | 0.66 | 960 | 1242 | 6.5 | 0.77 | 2.5 |
| Comparative Steel 1 | 89(76) | 11 | 0.68 | 963 | 1261 | 6.9 | 0.76 | 2.5 |
| Inventive Steel 3 | 91(82) | 9 | 0.67 | 1029 | 1281 | 6.3 | 0.8 | 2.5 |
| Comparative Steel 2 | 85(34) | 15 | 0.58 | 825 | 1253 | 7.4 | 0.66 | 3.3 |
| Comparative Steel 3 | 87(35) | 13 | 0.36 | 893 | 1305 | 7.1 | 0.68 | 3.3 |
| Comparative Steel 4 | 94(38) | 6 | 0.4 | 1036 | 1596 | 3.1 | 0.65 | 3 |
| Comparative Steel 5 | 95(34) | 5 | 0.24 | 969 | 1678 | 6.2 | 0.58 | 3.3 |

In Table 2, FM indicates martensite, TM indicates tempered martensite, F indicates ferrite, B indicates bainite, b/a indicates a ratio of C+Mn concentration in the martensite (a) to C+Mn concentration in the total of ferrite and bainite (b), YS indicates yield strength, TS indicates tensile strength, YR indicates yield ratio, El indicates elongation, R/t indicates number of bending index, R indicates radius of curvature, and t indicates thickness of specimen.

As shown in Tables 1 and 2, when the component ranges and manufacturing conditions of the present disclosure are satisfied, it can be understood that a high yield ratio type high-strength steel having yield strength of 920 MPa or greater, tensile strength of 1200 MPa or greater, a yield ratio of 0.77 or greater, elongation of 6% or greater, and a bending index of 3% or lower (R/t: R: Radius of Curvature, t: Thickness of Specimen) may be produced.

On the other hand, comparative steels 1 to 5, which do not satisfy relationship 1 of the present disclosure, do not satisfy the component ranges of the present disclosure, such that the yield ratio may be low. Further, comparative steel 4 has low elongation.

As shown in FIG. 1, it can be seen that the microstructure of Invention Steel 3 is composed of martensite and tempered martensite. Such a structure may be advantageous for securing a high-strength steel having yield strength of 920 MPa or greater and a yield ratio of 0.77.

Figure 2:
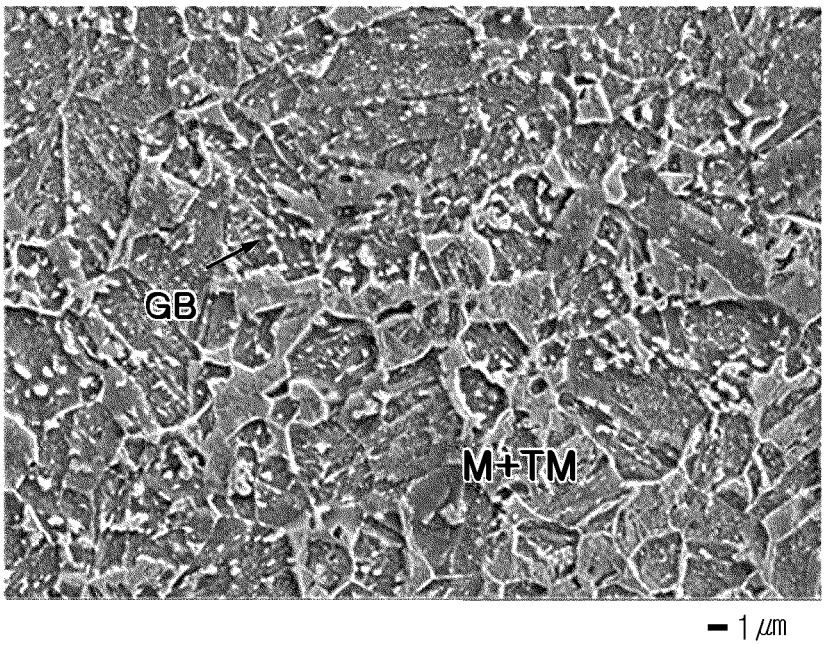
FIG. 2 is a microstructure photograph of comparative steel 2 produced under conditions of an annealing temperature of 820° C. and a cooling ending temperature (RCS) of 410° C.

On the other hand, as shown in FIG. 2, it can be seen that the microstructure of comparative steel 2 contains a structure of martensite+tempered martensite as well as a high-temperature microstructure (granular bainite, or the like) in an amount of 15% or more. The steel material with such a structure may have a low yield ratio such that the yield strength is 920 MPa or less, as can be seen from Table 2.

Therefore, to secure the material properties of the present disclosure, it can be understood that a control of the annealing temperature and the cooling ending temperature as well as the chemical components may be very important.

For example, even in a case that the conditions in the components of the present disclosure are satisfied, when the annealing temperature and the cooling ending temperature do not satisfy relationship 1, the yield strength may be as low as 920 MPa or less, and the yield ratio may be especially very low. Therefore, the desired characteristics of the present disclosure will not be satisfied. This may be due to the generation of ferrite or the formation of a high-temperature transformation phase such as granular bainite in the steel.

Example 2

Figure 3:
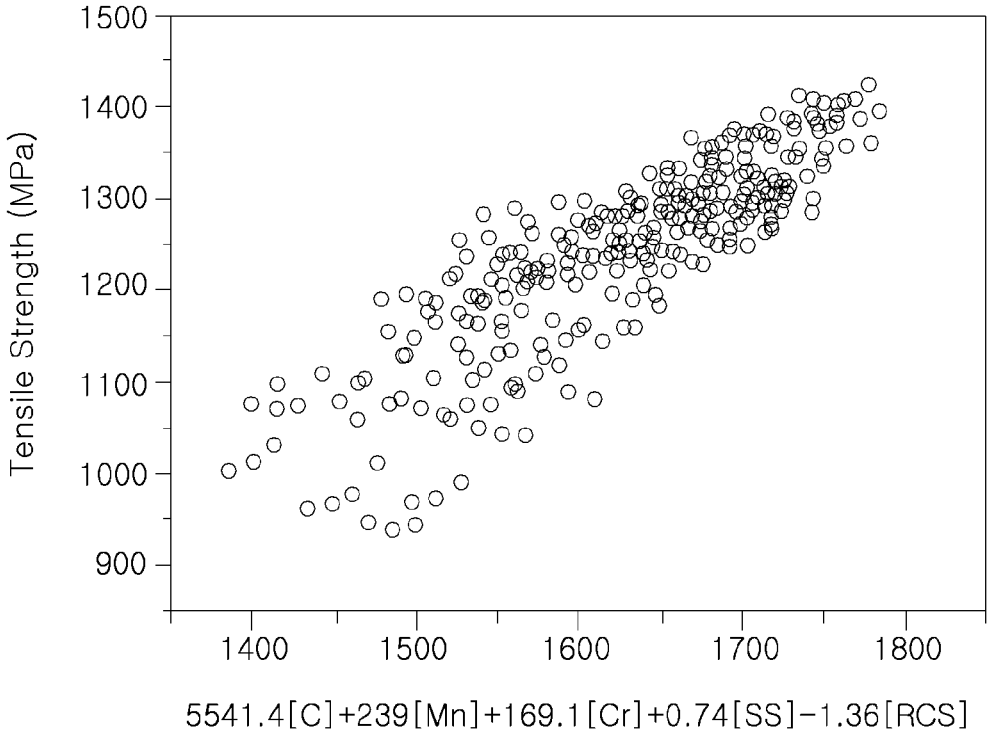
FIG. 3 is a graph illustrating a change in tensile strength according to a change of 5541.4C+239Mn+169.1Cr+0.74SS−1.36RCS.

A change in tensile strength according to a change of 5541.4C+239Mn+169.1Cr+0.74SS−1.36RCS in Inventive Steel 2 of Example 1 was examined, and the results obtained therefrom are shown in FIG. 3.

(Wherein C, Mn and Cr are values indicating an amount of each element in weight %, SS may be a continuous annealing temperature (° C.), and RCS may be a cooling ending temperature (° C.) at the time of continuous annealing.)

As shown in FIG. 3, when the value of 5541.4C+239Mn+169.1Cr+0.74SS−1.36RCS is in the range of the present disclosure, it can be seen that the tensile strength is 1200 MPa to 1300 MPa.

Figure 4:
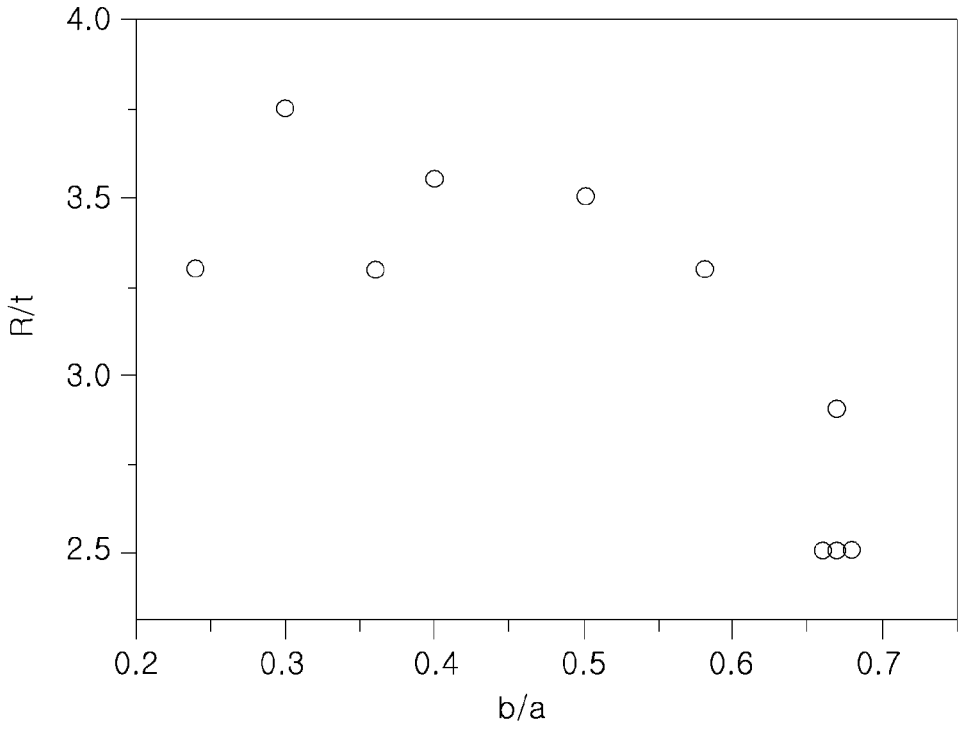
FIG. 4 is a graph illustrating a change in a bending index (R/t) according to a change in b/a (ratio (b/a) of C+Mn concentration in the martensite (a) to C+Mn concentration in the total of ferrite and bainite (b)).

A change in a bending index (R/t) according to a change in b/a (ratio (b/a) of C+Mn concentration in the martensite (a) to C+Mn concentration in the total of ferrite and bainite (b)) was examined, and the results obtained therefrom are shown in FIG. 4.

As shown in FIG. 4, when the b/a value satisfies the range of the present disclosure, it can be understood that the bending property may be excellent.

While exemplary embodiments have been shown and described above, it will be apparent to those skilled in the art that modifications and variations could be made without departing from the scope of the present disclosure as defined by the appended claims.

The invention claimed is:

1. A high-strength cold-rolled steel sheet produced by a method comprising a continuous annealing, the cold-rolled steel sheet comprising:

by weight, 0.1% to 0.15% of carbon (C), 0.2% or less of silicon (Si), 2.3% to 3.0% of manganese (Mn), 0.001% to 0.10% of phosphorus (P), 0.010% or less of sulfur (S), 0.01% to 0.10% of Sol. aluminum (Al), more than 0% and 0.010% or less of nitrogen (N), 0.3% to 0.9% of chromium (Cr), 0.0010% to 0.0023% of boron (B), 0.01% to 0.03% of titanium (Ti), 0.01% to 0.03% of niobium (Nb), and a remainder of iron (Fe) and other impurities, and satisfying the following relationship 1, $$1650 \leq 5541.4C+239Mn+169.1Cr+0.74SS-1.36RCS \leq 1688, \quad \text{[relationship 1]}$$

where C, Mn and Cr are contents of each element in weight %, SS is a heating and maintaining temperature (° C.) of a continuous annealing, and RCS is a cooling ending temperature (° C.) after the continuous annealing;

a microstructure comprising, by area %, 90% or greater and less than 100% of a sum of martensite excluding 0% and tempered martensite, and more than 0% and 10% or less of a sum of ferrite excluding 0% and bainite excluding 0%, wherein a fraction of the tempered martensite in the sum of martensite and tempered martensite is, by area %, 90% or greater and less than 100%, and a ratio (b/a) of (C+Mn) concentration in the martensite (a) to (C+Mn) concentration in the sum of ferrite and bainite (b) is 0.65 or greater; and a yield strength of 920 MPa or greater, a tensile strength of 1200 MPa or greater, and a yield ratio of 0.77 or greater.

2. The high-strength cold-rolled steel sheet according to claim 1, further comprising: an elongation of 6% or greater, and a bending index (R/t) of 3% or lower, where R/t: R is Radius of Curvature and t is Thickness of Specimen.

3. The high-strength cold-rolled steel sheet according to claim 1, wherein the tensile strength is 1200 MPa to 1300 MPa.

* * * * *